US005104097A

United States Patent [19]

Naujokat et al.

[11] Patent Number: 5,104,097

[45] Date of Patent: Apr. 14, 1992

[54] GAS STIR PLUGS WITH SLOTS AND METHOD OF MAKING THE SAME

[75] Inventors: Erich Naujokat, Krefeld; H. Dieter Vahlhaus, Muhlheim an der Ruhr; H. Wolfgang Steichert, Krefeld; H. Walter Klein, Essen, all of Fed. Rep. of Germany

[73] Assignee: Martin & Pagenstecher GmbHA, Fed. Rep. of Germany

[21] Appl. No.: 583,058

[22] Filed: Sep. 14, 1990

[51] Int. Cl.[5] ..... C21C 7/00

[52] U.S. Cl. ..... 266/217; 266/265

[58] Field of Search ..... 266/217, 218, 220, 265

[56] References Cited

U.S. PATENT DOCUMENTS

| | | | |
|---|---|---|---|
| 4,438,907 | 3/1984 | Kimura et al. | 266/217 |
| 4,535,975 | 8/1985 | Bührmann et al. | 266/220 |
| 4,560,149 | 12/1985 | Höffgen | 266/220 |
| 4,657,226 | 4/1987 | Illemann et al. | 266/220 |
| 4,899,992 | 2/1990 | Thrower et al. | 266/220 |

*Primary Examiner*—Scott Kastler

*Attorney, Agent, or Firm*—Caesar, Rivise, Bernstein, Cohen & Pokotilow, Ltd.

[57] ABSTRACT

A stirring plug for introducing gas into a mass of molten metal and a method of making the plug. The plug is of a generally frusto-conical shape having a central axis and includes plural elongated slots formed of generally smooth walls extending between the top and bottom ends of the plug and arranged in a frustum array. Each of the slots has a predetermined cross sectional area in any plane perpendicular to the central axis. The method comprises providing a member having a hollow frusto-conical shape cavity and inserting plural wax coated steel tapes or plastic tapes in a frustom array therein. The cavity is then filled with a refractory castable mix and it is allow to air set to form a frusto-conical body. That body is then heated to an elevated temperature to form a dense ceramic plug. In the case of the plastic tapes the heating of the mix causes the tapes to melt or sublime to form the slots. In the case of the steel tapes after the mix has air set it is heated to a modest heat to melt the wax on the tapes so that they can be pulled from the mix to form the slots.

29 Claims, 3 Drawing Sheets

FIG. 1
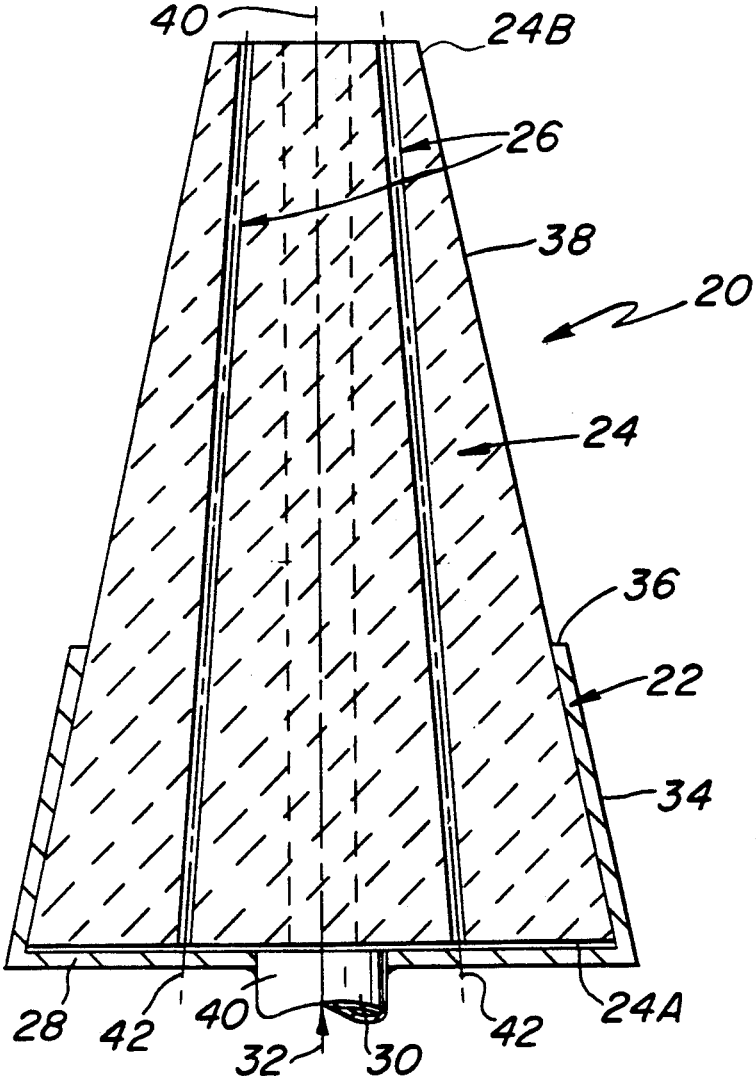
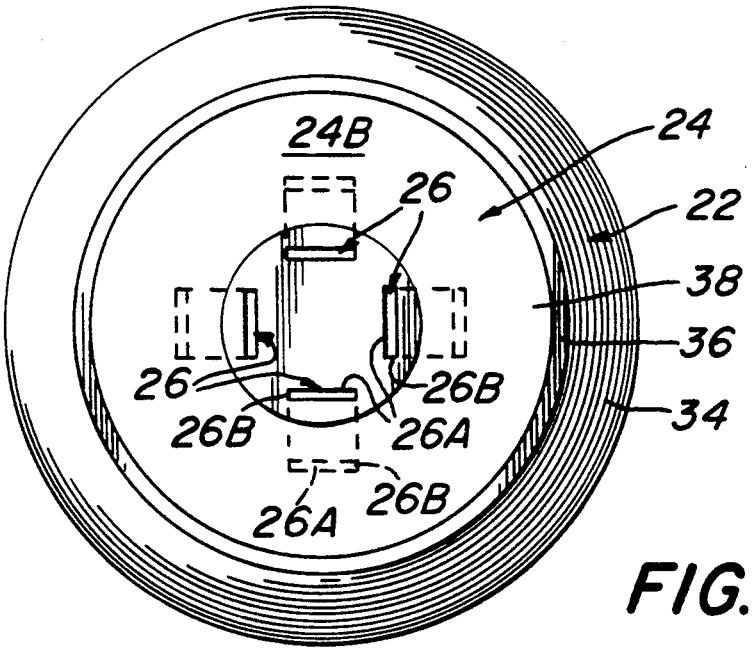
FIG. 2

FIG. 3
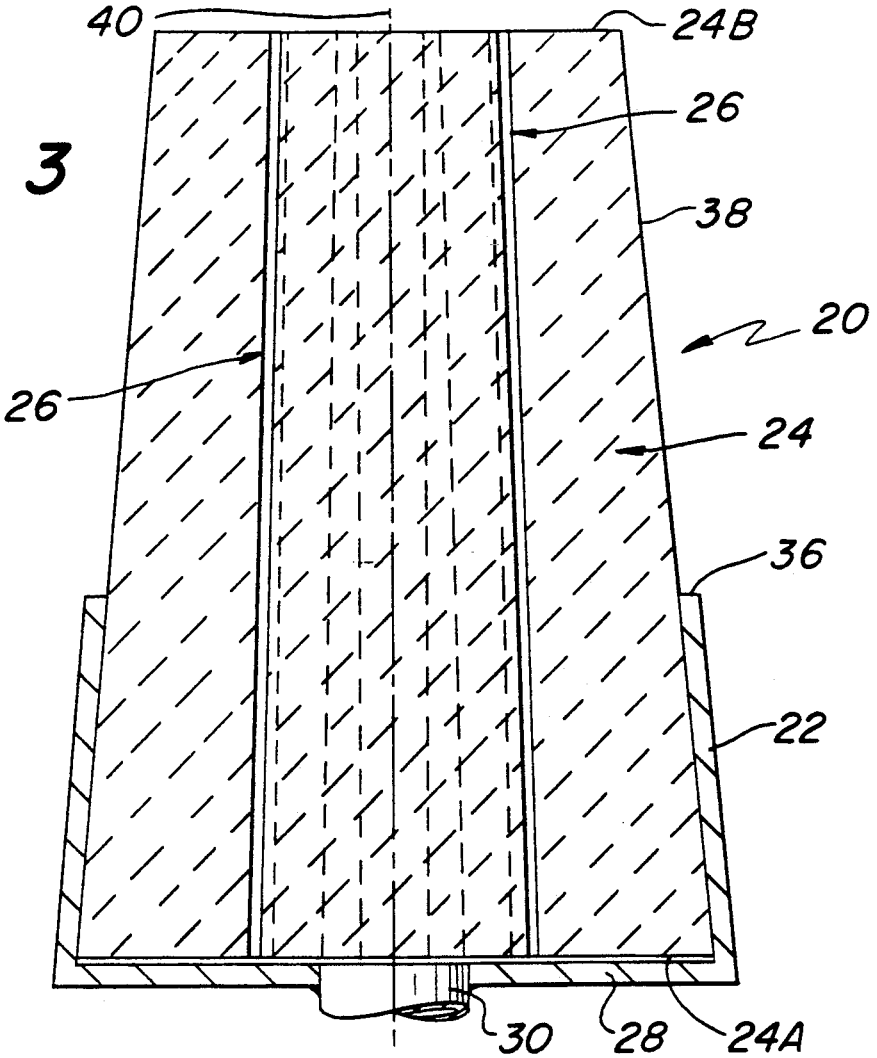
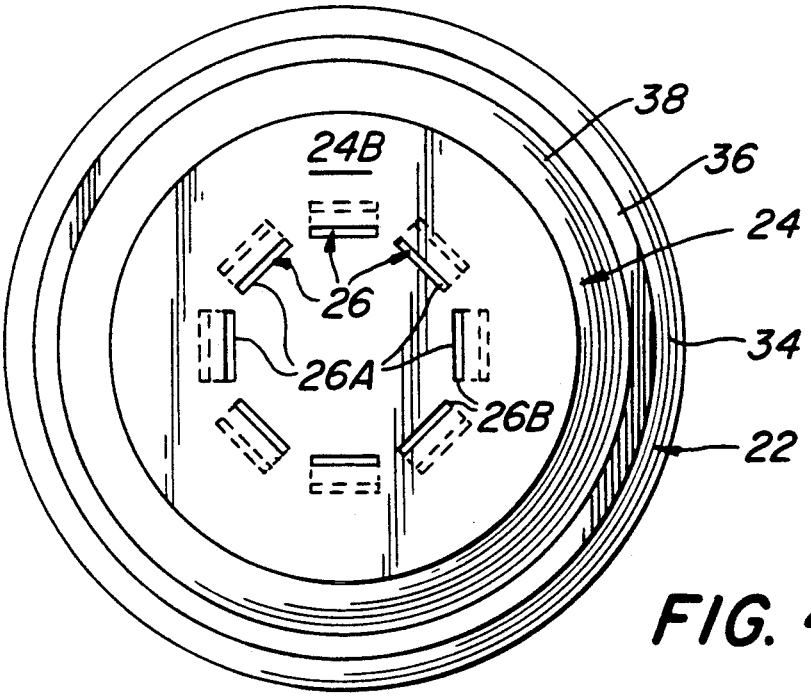
FIG. 4

GAS STIR PLUGS WITH SLOTS AND METHOD OF MAKING THE SAME

BACKGROUND OF THE INVENTION

This invention relates generally to devices for insufflating gas into a mass of molten metal, e.g., steel, and methods of making such devices.

The making of steel or other metals typically involves the introduction of gases into the ladle or vessel holding the molten metal in order to stir it. The gas is typically introduced into the ladle via a device called a stirring plug. Such a plug may be mounted in the bottom or side of the vessel. Prior art stirring plugs have taken numerous forms and constructions.

For example, one common type of stirring plug comprises a solid, non-gas-permeable, conical refractory member disposed within a loose fitting metal or ceramic shell or canister. Such a "canistered" plug is commonly disposed within a seating block in the wall, e.g., the bottom, of the vessel holding the molten metal, and the purging gas is transported through the gap between the refractory cone and the metal canister into the molten metal in the vessel.

In U.S. patent application Ser. No. 07/362,998, filed on June 8, 1989, entitled Refractory Gas Stir Plugs With Interconnecting Surface Channels And Method Of Making The Same, and in U.S. patent application Ser. No. 07/363,240, filed on June 8, 1989, entitled Gas Stir Plugs With Multichannel Monograin Surface And Method Of Making The Same, there are disclosed and claimed "canistered" plugs which overcome the disadvantages of various prior art canistered stirring plugs having gas passageways formed between the refractory cone and the metal canister.

Another common type of stirring plug comprises a conical shaped member or plug formed of a porous refractory material through which the purging (stirring) gas is passed to produce fine gas bubbles to stir the molten metal. Thus, that type of plug utilizes the porosity of the material forming the plug to create a capillary system formed by the interstitial spaces between the porous material for carrying the stirring gas through the plug. Such plugs are commonly disposed within a seating block in the wall, e.g., bottom, of the vessel.

Another type of uncanistered plug is the so-called directed porosity plug. That plug comprises a conical body of cast refractory material containing an array of fine, e.g., 0.7 mm diameter, channels that run in a straight line from the bottom to the top of the plug. When these plugs are used the gas is distributed very finely in the melt by means of the capillaries, but as it passes through the capillaries it undergoes a very high degree of friction loss as a result of the turbulence which develops on the inside surfaces of the capillaries. The effects of this turbulence on the flow of gas decreases with increasing size of the capillary cross section. Thus, it is not possible to increase the diameter of the capillaries to any desired extent in order to minimize friction since such action would enable the molten metal to penetrate too deeply into the capillaries and block them in the event that the flow of gas should cease.

Only a large number of capillaries can guarantee the very high gas flow rate frequently desired in a steel mill. From the production angle, however, this turns out to be very expensive. Thus, to reduce friction losses, it was found advantageous to form a conical stirring plug of a single or multi-part construction to provide plural identical joints (in the case of a multi-part construction) or slots or passageways (in the case of a single part construction) extending linearly from the bottom to the top of the plug. Such "jointed/slotted" plugs exhibit similar gas agitation properties as the capillary tube plugs, but with significantly smaller pressure losses.

The joints or passageways in one type of conical "jointed/slotted" plug, such as shown in German Patent No. DE 3,538,498, are generally of arcuate shape in transverse cross-section, i.e., perpendicular to the longitudinal central axis of the conical plug, with the diameter of the arc sections decreasing linearly from the bottom of the plug to its top. Moreover, the width of each passageway at the top of the plug (such width being typically within the range of 10–30 mm) is less than at the bottom of the plug (such width being typically within the range of 25–50 mm), with the thickness of the passageway being constant along its length (such thickness being typically within the range of 0.1–1 mm). Such conicity of passageways serves to minimize the friction loss as the purging or stirring gas passes through the passageways. Moreover, this type of plug exhibits a high gas flow rate per unit of time (such as that achieved by use of a very large number of capillaries) with a small number of passageways. However, the conically upward-tapering geometry of the passageways leads to very low friction losses, the gas-conducting open space is difficult to blow out or blast free of metal should the molten metal run into them and solidify, because the solidified metal forms a wedge and thus locks itself in place, preventing its ejection. Moreover, if the plug is formed of a multi-part design, e.g., an internal mandrel located within an external sleeve, with the joints being located at the interface of the parts, the parts can shift location with respect to each other and thus increase the thickness of the joint. The immediate consequence of such action would be agitation failure, because molten metal could run too far into the plug and thereby block the gas-conducting free space.

In another type of conical "jointed/slotted" plug, such as shown in German Patent No. DE 3,625,117, each of the passageways is rectangular and of constant cross-section from the bottom of the plug to its top. The passageways are arranged in a radial, starburst configuration, with their longitudinal central axes being located in a cylindrical locus. This type of plug also exhibits a high gas flow rate per unit of time by use of a relatively small number of passageways. However, the radial, starburst design of the passageways leads to an undefined cracking of the passageways toward the outside edge of the plug. Such action occurs because, in the case of a steel-blocked passageway, the gas pressure being exerted on the remaining webs, i.e., the material between the outside edge of the passageway and the outer surface of the plug, creates considerable tensile stress.

Disposing the passageways in a cylindrical array within the plug prevents cracking toward the outer surface of the plug, but is not without its own disadvantage. In this regard if the plug is constructed so that the passageways are disposed in a cylindrical array, with their longitudinal central axes being located in a cylindrical locus, the distances separating the immediately adjacent passageways from each other is constant over the entire height of the plug. The pressures and temperature changes occurring during operation lead to cracking, primarily from the edge of one passageway to the edge of an immediately adjacent passageway. This can lead to the formation of circular cracks within the body of the plug. Such cracks may extend the entire height of the plug, i.e., become cylindrical. Moreover, because the spacing between the immediately adjacent passageways in a cylindrically disposed arrangement is of equal width from the bottom of the plug to the top, such circular cracks can readily propagate over the entire height of the plug and lead to the breaking off of a piece of the plug at any point.

In order to reduce the pressure loss problem inherent in plugs having joints or passageways therein through which the stirring gas passes the joints/passageways are sometimes constructed to increase in cross sectional are from the top to the bottom of the plug. High volume gas flow through such plugs is achieved through use of a small number of joints/passageways (as opposed to a large number of capillaries as is the case with porous or capillaried plugs). Plugs utilizing increasing cross sectional area joints/passageways, while producing low friction losses, nevertheless have the disadvantage that as the plug wears down during use molten metal penetration increases after the gas flow is terminated due to the increased cross sectional area of the joints/passageways. Further still such plugs (due to the decreased cross sectional area of the joints/passageways going from the bottom of the plug to the top) have the disadvantage of increasing the difficulty in blowing out penetrated molten metal from the joints/passageways.

Prior art stirring plugs are also found in the following U.S. Pat. Nos. 4,535,975 (Buhrmann et al.), 4,539,043 (Miyawaki et al.), 4,647,020 (Leisch), 4,741,515 (Sharma et al.), 4,836,433 (Perry), 4,840,356 (Labate), 4,858,894 (Labate), 4,884,787 (Dotsch et al.), 4,898,369 (Perry), 4,905,971 (Rothfuss et al.), and 4,925,166 (Zimmermann), and in European Patents Applications: EP 311,785 A1, and EP 326,882 A2.

OBJECTS OF THE INVENTION

Accordingly, it is a general object of this invention to provide a gas stirring plug and a method for making the same which overcomes the disadvantages of the prior art.

It is a further object of this invention to provide a gas stirring plug which is simple in construction.

It is still a further object of this invention to provide a gas stirring plug which can be manufactured easily and inexpensively.

It is yet a further object of this invention to provide a gas stirring plug which is effective in operation.

It is another object of this invention to provide a gas stirring plug which is resistant to blockage.

It is still a further object of this invention to provide a gas stirring plug which is resistant to cracking.

It is yet a further object of this invention to provide a method of making a gas stirring plug which may be effected easily and inexpensively.

SUMMARY OF THE INVENTION

These and other objects of the instant invention are achieved by providing a device for introducing gas into a mass of molten metal and a method of making the device.

The device comprises a plug of generally frusto-conical shape having a central axis, a top end, a bottom end, and a conical outer surface located between the top end and the bottom end and extending about a central longitudinal axis of the plug. The plug is formed of a refractory material having plural slots therein arranged in a frustum array for carrying gas therethrough between the plug's bottom end and its top end. Each of the slots comprises a generally linear passageway having a respective longitudinal axis extending at an angle to the central longitudinal axis of the plug. Each of the slots is of a first predetermined rectangular, cross-sectional area in a plane perpendicular to the central longitudinal axis of the plug, with the cross-sectional area of each slot in any of those planes being no less than the cross-sectional area of each slot in any plane closer to the bottom end of the plug.

The method comprises providing a hollow cavity of frusto-conical shape into which are plural tapes in a frustum array are inserted. The hollow body is thereafter filled with a refractory castable material mix and the mix is then air set. Thereafter the body with the castable mix and the bands therein is subjected to an elevated temperature to cause the mix to form a dense ceramic body. The tapes are removed from the ceramic body to form the slots.

In one preferred embodiment of the method of this invention the tapes are formed of a material which melts or sublimes upon the application of heat thereto, whereupon when the mix is heated to create the ceramic body the tapes melt/sublime to form the slots. In another preferred embodiment of the method of this invention the tapes are formed of steel and are coated with a release agent material to enable the tapes to be readily pulled from the plug to form the slots and without damaging the plug.

DESCRIPTION OF THE DRAWING

FIG. 1 is a front elevational view, partially in section, of one embodiment of a stirring plug constructed in accordance with this invention;

FIG. 2 is a top plan view of the plug shown in FIG. 1;

FIG. 3 is a front elevational view, partially in section, of a second embodiment of a stirring plug constructed in accordance with this invention;

FIG. 4 is a top plan view of the plug shown in FIG. 3;

DETAILED DESCRIPTION OF THE PREFERRED EMBODIMENT

Figure 6:
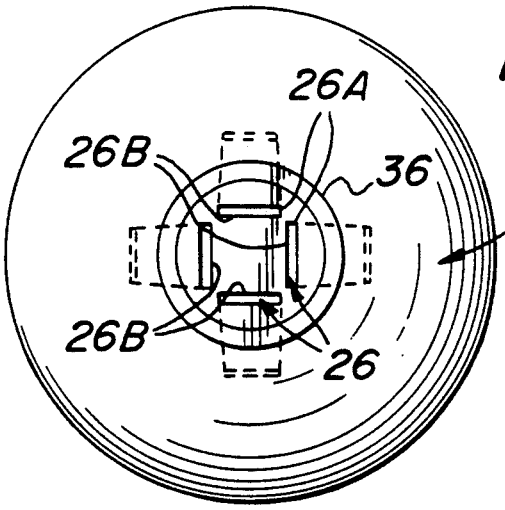
FIG. 6 is a top plan view of the plug shown in FIG. 5.

Referring to FIG. 1, there is shown one embodiment of a stirring plug 20 constructed in accordance with this invention. The stirring plug 20 basically comprises a frusto-conically shaped shell or canister 22 having a frusto-conically shaped insert or plug 24 located therein. A plurality of passageways or slots 26 extend through the plug 24 for transporting a stirring gas through the plug 20 from its bottom surface 24A to it top surface 24B, as will be described later.

The shell is preferably formed of any suitable material, such as stainless steel, a fired ceramic or a ceramic coated metal. The shell includes a generally planar bottom wall 28 having an inlet port or conduit 30, into which any suitable stirring gas may be introduced in the direction of arrow 32, and a peripherally extending conical side wall 34 terminating at its upper end in an opening 36.

The insert or plug 24 is formed of any suitable material, e.g., a non-permeable ceramic material, and is shaped to closely fit within the interior of the shell 22. The sidewall 34 of the shell may extend only partially, e.g., from one third to one half, the height of the plug (as shown in FIGS. and 3) or may extend the full height of the plug (as is the case of the embodiment shown in FIG. 5).

The plug 24 being of frusto-conical shape includes a conical outer surface 38 extending between the bottom surface 24A and the top surface 24B and about the central longitudinal axis 40 of the plug. The plug's top and bottom surfaces are each substantially planar and are disposed perpendicularly to the central longitudinal axis 40 of the plug.

As can be seen in FIGS. 1 and 2 there are four slots 26 in the plug 24. The slots 26 are disposed in an array of predetermined configuration so that the slots extend about the central longitudinal axis 40 of the plug between its bottom surface 24A and its top surface 24B, as will be described hereinafter. The slots serve to carry a stirring gas introduced the plug via conduit 30 out through the plug's top end to effect stirring of molten metal in the vessel (not shown) in which the stirring plug 20 is located.

Each slot 26 comprises an elongated, linearly extending passageway having a central longitudinal axis 42. The slots 24 are disposed so that the central longitudinal axis of each slot extends at a predetermined acute angle to the central longitudinal axis 40 of the plug, and with the central longitudinal axis of all of the slots 26 defining a conical locus centered about axis 40 and tapering from the bottom of the plug to the top thereof. Each slot is preferably of rectangular cross-section in any plane perpendicular to the longitudinal central axis 40 of the plug, with each slot having a predetermined width 26A and thickness 26B. The slots are oriented so that the width dimension of each slot is tangent to the circular locus defined by the longitudinal axes 42 of all of the slots. Thus, the slots 26 form a frustum shaped array about the central longitudinal axis 40 of the plug.

The under surface 24A of the plug 24 is spaced slightly above the inner surface of the bottom wall 28 of the sleeve. Accordingly the lower end of each slot 26 is in fluid communication with the conduit 30 into which the stirring gas is introduced.

Preferably the walls forming the periphery of the slots are smooth so that each slot can transport gas therethrough with low frictional loss from the bottom of the plug to its top. Moreover, the slots are each configured to minimize the danger of slot blockage caused by the intrusion and freezing of the metal in the slot as the plug wears down should the flow of gas therethrough become interrupted or terminated. In particular, in accordance with the teachings of this invention the cross-sectional area of each slot 26 in any plane perpendicular to the central longitudinal axis 40 of the plug is not less than the cross-sectional area of that slot in a plane located closer to the bottom of the plug (See FIGS. 1, 3, and 5). This feature enables any metal which may enter and freeze at the top end of any slot to be ejected therefrom by merely introducing gas into the conduit 30 for passage up through the slot to blow the slot free of the frozen metal. Thus, in the embodiment of the plugs shown in FIGS. 1–4 the cross-sectional area of each slot is the same along the entire height of the plug.

In accordance with a preferred embodiment of this invention the thickness of each of the slots 26 is substantially less than the width thereof. For example, the width 26A of each slot 26 is within the range of 5–50 mm (most preferably within the range of 5–25 mm), while the thickness 26B of each slot is within the range of 0.05 to 1.0 mm (most preferably within the range of 0.1 to 0.5 mm).

It must be pointed out at this juncture that the number, size, and orientation of the slots 26 shown in FIGS. 1 and 2 is merely exemplary. Thus, the plug 24 may include more or fewer than four slots, with the angle of the slots to the longitudinal central axis 40 of the plug being greater or less than that shown. For example, in FIGS. 3–4 there is shown an alternative embodiment of the stirring plug 20, utilizing eight slots 26, each of which extends at a lesser acute angle to the central axis 40 of the plug than that of the embodiment of FIGS. 1–2. Moreover, the spacing of the slots radially, i.e., the distance of the slots from the outer surface 38 of the plug, can be any desired value depending upon the size of the plug itself. However, it is preferred that the distance between each slot and the outer surface of the plug immediately adjacent thereto at the top of the plug be smaller than that distance at the bottom of the plug. In the embodiments shown in FIGS. 1 and 2 the radial distance between any slot at the top of the plug and the plugs's outer surface may be in the range of 5.0 mm to 40 mm, whereas the radial distance between any slot at the bottom of the plug and the plug's outer surface may be in the range of 30 mm to 100 mm.

Figure 5:
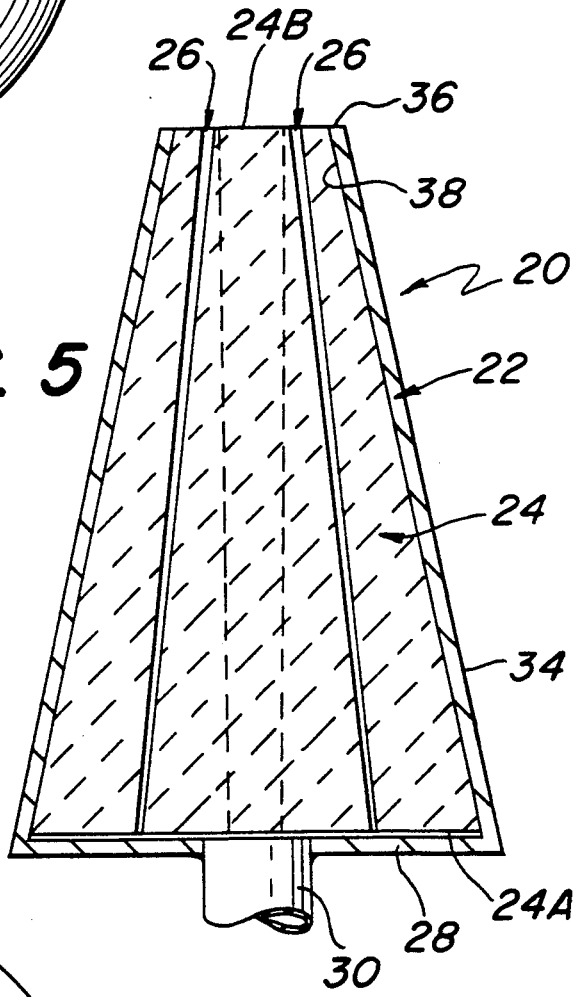
FIG. 5 is a front elevational view, partially in section, of a third embodiment of a stirring plug constructed in accordance with this invention.
Figure 7:
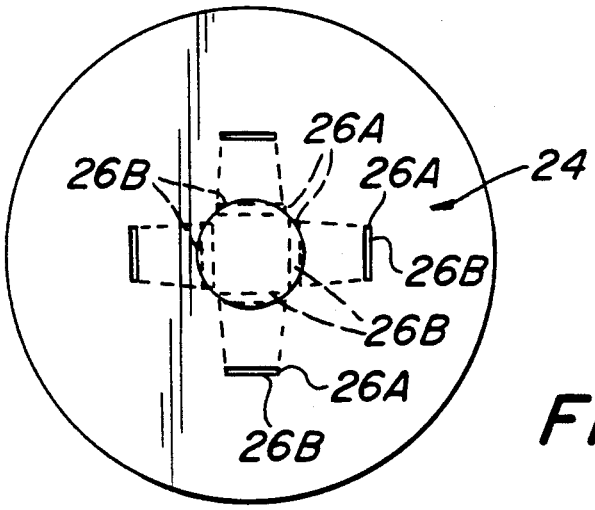
FIG. 7 is a bottom plan view of a portion of the plug shown in FIGS. 5 and 6.

In FIGS. 5–7 there is shown yet a further alternative embodiment of this invention. The plug 20 as shown in those figures is similar in construction to the embodiment of FIGS. 1–2 except that the cross sectional area of each of the slots 26 increases going from the bottom of the plug to its top. This feature further facilitates the ability of the slots to be cleared of frozen metal by introducing gas into the conduit 30. In the embodiment of the invention shown in FIGS. 5–7 the canister or shell 22 is shown as extending the full height of the plug 24. Such an arrangement is merely exemplary. Thus, in some applications the shell may extend only partially the height of the plug 24, like that shown in FIGS. 1–4.

As will be appreciated by those skilled in the art by utilizing slots arranged in a frustum array the plugs are resistant to crackage propagating to the surface of the plugs'surface. Moreover, the spacing of the slots vis a vis one another decreases from the bottom of the plug to its top, whereupon the nominal fracture location tends to occur at the top of the plug rather than at its bottom.

The plugs 24 of this invention are preferably made as a one-piece construction utilizing either of one of the following methods. Both methods include a common step. That step consists of providing a hollow body or mold (not shown) including a cavity of frusto-conical shape having walls configured and shaped to produce the frusto-conical plug 24. In accordance with one method a plurality of pretensioned plastic tapes or threads are positioned in the mold cavity in a frusto-conical arrangement to form the slots 26. Thus, each tape is of the appropriate size and cross sectional area for forming each slot 26. Once the tapes are appropriately positioned a ceramic compound mix is introduced into the mold cavity and allow to set. Heat, e.g., 400–500 degrees Celsius, is then applied, whereupon the plastic tapes either melt or sublime (depending upon their make-up) so that a free space is left behind in the ceramic compound corresponding to the slots. Alternatively, metal, e.g., hardened steel, tapes may be used and similarly positioned within the mold cavity. Such tapes preferably include a release agent, e.g., a low melting point wax, oil, grease, etc., thereon. Once the coated tapes are in position within the mold cavity, the ceramic compound or mix is introduced and packed around the tapes. In the case of the use of a wax coating on the tapes the compound is allowed to set. Thereafter modest heat, e.g., approximately 100 degrees Celsius, is applied so that the release coating on the tapes melts and leaves a space in the mix. The tapes can then be pulled out of the mix at ambient temperature with almost no friction. This action forms the slots without disturbing the mix. The plug is then ready to be baked, as is conventional, to make it ceramic.

Without further elaboration the foregoing will so fully illustrate our invention that others may, by applying current or future knowledge, adopt the same for use under various conditions of service.

We claim:

1. A device for introducing gas into a mass of molten metal comprising a plug of generally frusto-conical shape having a central axis, a top end, a bottom end, and a conical outer surface located between said top end and said bottom end and extending about a central longitudinal axis of said plug, said plug being formed of a refractory material having plural slots therein for carrying gas therethrough between said bottom end of said plug and said top end of said plug, each of said slots being an generally linear passageway having a respective longitudinal axis extending the height of said slot between said bottom end and said top end at an acute angle to said central longitudinal axis, each of said slots also being of a first predetermined cross sectional area in any plane perpendicular to said central longitudinal axis, said cross sectional area being bounded by a pair of long sides extending generally parallel to a first axis establishing the width of said slot and pair of short sides establishing the thickness of said slot, said long sides being longer than said short sides, said slots being arranged in a frustum array wherein said first axis of each of said slots extends generally tangentially to a radius of said plug measured from said central longitudinal axis, with the cross-sectional area of each slot in any of said planes being no less than the cross-sectional area of each slot in any plane closer to said bottom end of said plug.

2. The device of claim 1 wherein the cross sectional area of each slot in any of said planes being the same as in any other of said planes.

3. The device of claim 1 wherein the cross sectional area of each slot in any of said planes being greater than each slot in any plane located closer to said bottom end of said plug.

4. The device of claim 1 wherein said plug is formed as an integral unit.

5. The device of claim 4 wherein the cross sectional area of each slot in any of said planes being the same as in any other of said planes.

6. The device of claim 4 wherein the cross sectional area of each slot in any of said planes being greater than each slot in any plane located closer to said bottom end of said plug.

7. The device of claim 1 wherein said longitudinal axes of said slots are disposed in a conically shaped locus symmetrically surrounding said longitudinal central axis of said plug.

8. The device of claim 7 wherein the cross sectional area of each slot in any of said planes being the same as in any other of said planes.

9. The device of claim 7 wherein the cross sectional area of each slot in any of said planes being greater than each slot in any plane located closer to said bottom end of said plug.

10. The device of claim 1 wherein each of said slots is of rectangular cross-sectional area in any of said planes, with said thickness of said slot being in the range of 0.05 to 1.0 mm.

11. The device of claim 10 wherein said thickness is in the range of 0.1 to 0.5 mm.

12. The device of claim 1 wherein each of said slots is of rectangular cross-sectional area in any of said planes, with said width of said slot being in the range of 5 to 50 mm.

13. The device of claim 10 wherein said width is in the range of 5 to 25 mm.

14. The device of claim 10 wherein said width dimension is in the range of 5 to 50 mm.

15. The device of claim 14 wherein said thickness is in the range of 0.1 to 0.5 mm and said width is in the range of 10 to 25 mm.

16. The device of claim 2 wherein each of said slots is of rectangular cross-sectional area in any of said planes, with said thickness of said slot being in the range of 0.05 to 1.0 mm.

17. The device of claim 16 wherein said thickness is in the range of 0.1 to 0.5 mm.

18. The device of claim 2 wherein each of said slots is of rectangular cross-sectional area in any of said planes, with said width of said slot being in the range of 5 to 50 mm.

19. The device of claim 18 wherein said width is in the range of 5 to 25 mm.

20. The device of claim 2 wherein each of said slots is of rectangular cross-sectional area in any of said planes, with said width of said slot being in the range of 5 to 50 mm and said thickness of said slot being in the range of 0.05 to 1.0 mm.

21. The device of claim 20 wherein said thickness is in the range of 0.1 to 0.05 mm and said width is in the range of 5 to 25 mm.

22. The device of claim 3 wherein each of said slots is of rectangular cross-sectional area in any of said planes, with said thickness of said slot being in the range of 0.05 to 1.0 mm.

23. The device of claim 22 wherein said thickness is in the range of 0.1 to 0.5 mm.

24. The device of claim 2 wherein each of said slots is of rectangular cross-sectional area in any of said planes, with said width of said slot being in the range of 5 to 50 mm.

25. The device of claim 3 wherein each of said slots is of rectangular cross-sectional area in any of said planes, with said width of said slot being in the range of 5 to 50 mm and said thickness of said slot being in the range of 0.05 to 1.0 mm.

26. The device of claim 25 wherein said thickness is in the range of 0.1 to 0.5 mm and said width is in the range of 10 to 25 mm.

27. The device of claim 1 wherein said material comprises a dense ceramic.

28. The device of claim 4 wherein said material comprises a dense ceramic.

29. The device of claim 1 wherein the distance between each slot and said conical outer surface of said plug immediately adjacent thereto at the top of said plug is less than that distance at the bottom of said plug.

* * * * *